US008652312B2

(12) United States Patent
Catte

(10) Patent No.: US 8,652,312 B2
(45) Date of Patent: Feb. 18, 2014

(54) CATHODIC PROTECTION ASSESSMENT PROBE

(75) Inventor: Darrell Raymond Catte, Dhahran (SA)

(73) Assignee: Saudi Arabian Oil Company (SA)

( * ) Notice: Subject to any disclaimer, the term of this patent is extended or adjusted under 35 U.S.C. 154(b) by 328 days.

(21) Appl. No.: 13/026,802

(22) Filed: Feb. 14, 2011

(65) Prior Publication Data

US 2012/0205256 A1 Aug. 16, 2012

(51) Int. Cl.

| | |
|---|---|
| ***G01N 27/26*** | (2006.01) |
| ***C23F 13/06*** | (2006.01) |
| ***C23F 13/08*** | (2006.01) |
| ***C23F 13/16*** | (2006.01) |
| ***C23F 13/20*** | (2006.01) |

(52) U.S. Cl.

USPC ..... 204/404; 204/401; 205/725; 205/727; 205/740; 205/775.5; 205/776; 205/777

(58) Field of Classification Search

USPC ..... 204/401, 404; 205/725, 727, 740, 205/775.5, 776, 777

See application file for complete search history.

(56) References Cited

U.S. PATENT DOCUMENTS

| | | | | |
|---|---|---|---|---|
| 4,080,565 | A * | 3/1978 | Polak et al. | 324/71.1 |
| 5,216,370 | A * | 6/1993 | Bushman et al. | 324/425 |
| 5,814,982 | A * | 9/1998 | Thompson et al. | 324/71.1 |
| 5,999,107 | A | 12/1999 | Cooper | |
| 6,060,877 | A * | 5/2000 | Nekoksa | 324/71.1 |
| 6,183,625 | B1 * | 2/2001 | Staerzl | 205/727 |
| 6,744,265 | B2 | 6/2004 | Yunovich | |
| 6,772,622 | B2 | 8/2004 | Moghissi | |
| 7,027,957 | B2 * | 4/2006 | Fourie et al. | 702/188 |
| 7,190,154 | B2 * | 3/2007 | Biagiotti, Jr. | 324/71.1 |
| 7,285,203 | B2 * | 10/2007 | Russell et al. | 205/725 |
| 7,541,817 | B2 | 6/2009 | Nielsen | |
| 2003/0107105 | A1 | 6/2003 | Kozicki | |
| 2003/0189435 | A1 | 10/2003 | Yunovich | |
| 2007/0193887 | A1 * | 8/2007 | Tormoen et al. | 205/775.5 |
| 2007/0272544 | A1 * | 11/2007 | Bytyn | 204/196.11 |
| 2008/0047843 | A1 | 2/2008 | Glass | |
| 2010/0039127 | A1 * | 2/2010 | Orazem | 324/718 |

FOREIGN PATENT DOCUMENTS

| | | | |
|---|---|---|---|
| FR | 2490346 | A1 | 9/1981 |
| FR | 2898978 | A1 | 3/2006 |

OTHER PUBLICATIONS

International Search Report and Written Opinion for Related PCT Application PCT/US2012/025054, May 23, 2012.

* cited by examiner

*Primary Examiner* — Bruce Bell
(74) *Attorney, Agent, or Firm* — Bracewell & Giuliani LLP

(57) ABSTRACT

An apparatus and method for monitoring cathodic protection of a protected object that includes a probe with five segments in series. The cathodic protection is provided by a system with a power supply that impresses current onto the protected object. An anode is included with the system that is also connected to the power supply. The third and fifth segments are in electrical communication through a frangible connection; that over time galvanically corrodes to electrically isolate the third and fifth segments. The second segment, which is a permanent isolator, is set between the first and third segments. The third segment is selectively connected with the protected object. When the third segment is selectively disconnected from the protected object, measuring the potential difference between the third segment and the first segment yields a value for object polarization that is void of IR error.

18 Claims, 5 Drawing Sheets

CATHODIC PROTECTION ASSESSMENT PROBE

BACKGROUND OF THE INVENTION

1. Field of the Invention

The present invention relates to an apparatus and method for use with a corrosion monitoring and/or mitigation system. More specifically, the invention relates to an apparatus and method for monitoring cathodic protection while supplying cathodic protection power to an object being protected. Yet more specifically, the invention relates to a system for determining electrolyte corrosivity and optimum site specific cathodic protection operating levels.

2. Description of the Related Art

Cathodic protection systems mitigate corrosion of metallic objects that are partially or wholly submerged in mediums (such as soil or water) where they are exposed to corrosive electrolytes. For example, points or sections on pipelines immersed subsea or buried under the earth's surface can experience an electrical potential difference from other portions of the pipeline because of characteristics in the medium, or differing characteristics in the pipeline itself. Corrosion results when the potential difference causes electron flow between the pipeline sections of different potential. Cathodic protection involves placing an anodic material in the common electrolyte with a corroding metallic surface and providing an electrical connection between the anodic material and the corroding metal. The anodic material can be galvanically anodic, or forced to be anodic with the use of an external dc power supply. The surface that is more anodic experiences corrosion, and the surface that is less anodic (or more cathodic) does not corrode. The pipeline surface then becomes more negatively polarized than it previously was. The steel will not break down into Fe+ ions and electrons when there is already an excess of electrons on the steel surface. The steel surface in this condition is cathodic relative to the anode material. If correctly applied, all corrosion occurs on the anode material.

Current is sometimes impressed onto the protected metallic object, provided via electrical power, to make the protected metallic object more cathodic (electrically negative) than the anode. Monitoring the effectiveness of the cathodic protection is generally performed by measuring the electrical potential of the protected metallic object relative to a reference electrode that is set in the water or soil. The electrical potential can be measured when the current is being impressed onto the protected metallic object (referred to as on potential) or not being impressed (referred to as off potential). The resistance of the soil or water and protected metallic object introduce a measurement error (IR error) due to a corresponding voltage drop from the resistance. Interrupting the current supply to the protected metallic object and instantaneously measuring the potential between the protected metallic object and reference electrode (referred to as instant off potential) yields a value for potential void of IR error.

Cathodic protection for well casings and long pipelines is typically applied in an impressed current configuration, e.g., from an external DC power supply. Impressed current cathodic protection involves the introduction of a conductive material (typically cast iron rods) buried in the ground and electrically connected to the positive (anode) terminal of an external DC power supply. The negative (cathode) terminal of the power supply is connected to the structure to be cathodically protected.

SUMMARY OF THE INVENTION

The present disclosure discloses a method and apparatus for monitoring and assessing cathodic protection of an object within a medium. In an example, disclosed herein is a system for measuring cathodic protection of a protected object submerged in a medium and protected by an impressed current and an energized anode submerged in the medium. In one embodiment the system is made up of a segmented probe. In an example embodiment, the probe has first, second, and third segments. One of the first or third segments is in selective electrical communication with the protected object. When one of the first and third segments are in electrical communication with the protected object, the first and third segments are electrically isolated by the second segment and a cathodic protection current is impressed onto the protected object. Measuring polarization between the first and third segments substantially reflects the polarization of the protected object without any IR error. In another embodiment, fourth and fifth segments are included, where the fourth segment is a galvanically corroding connection between the fifth and third segments. The galvanically corroding connection of the fourth segment can include a material with a galvanically noble value, so that when the probe is set in a galvanically non-corrosive medium the electrical communication between the fifth and third segment is maintained through the galvanically corroding connection; additionally when the probe is set in a galvanically corrosive medium the galvanically corroding connection galvanically corrodes and the fifth segment is electrically isolated from the third segment. A multi-meter can be included with the system that is in electrical communication with the protected object and the electrically conducting segments. The first segment can be fabricated in a geometry that has been used in the lab to establish cathodic disbondment characteristics for a variety of representative coatings in a variety of representative electrolytes. The coated lab samples can be prepared with an engineered flaw that is of the same geometry as the first segment. The system can include a power supply for providing the impressed current. Alternatively, a controller is included with the system that is in communication with the power supply, the first segment, and the second segment. The electrical connection between the protected object and one of the first or second segments can be made up of an electrically conducting member and an on off switch in the electrically conducting member. The protected object can be a pipeline, a tank, a structure, a reinforcing bar, or a vessel. The medium can be soil, sand, rock, clay, water, a cementitious material, or combinations thereof. Also described herein is a method and apparatus for monitoring and assessing corrosion and cathodic protection of an object within an electrolyte and can also be used to measure electrolyte resistivity and galvanic corrosivity (qualitatively).

Also described herein is a cathodic protection system for cathodically protecting a metallic object that contacts a medium. In this embodiment the cathodic protection system includes a power source coupled to the metallic object, so that when the power source is energized current is impressed onto the metallic object. In an embodiment, an anode is connected to the power source and contacting the medium. In an embodiment, a probe is included that contacts the medium and made up of a first segment that is physically connected to the third segment but electrically isolated by a nonmetallic second segment. The first and third segments are selectively disconnectable from each other and the object through wires terminated above ground. Optionally included is a multi-meter coupled to the metallic object, the first segment, and the second segment. Further optionally included is a controller connected to the multi-meter and the power source, so that when the multi-meter measures polarization values between the second segment and the metallic object that are outside of a predetermined range, the controller can adjust the power supply to change the level of cathodic protection. In an example, the predetermined range of polarization indicates a desired level of cathodic protection. In an embodiment, a third segment is included with the probe that is electrically isolated from the first and second segments. Electrical connection between the protected object and one of the segments can be a conducting member with an included on/off switch. The metallic object can be a pipeline, a tank, a structure, a reinforcing bar, or a vessel. The medium can be soil, sand, rock, clay, water, a cementitious material, or combinations thereof.

Yet further disclosed herein is a method of monitoring cathodic protection of a metallic object that contacts a medium. In an example, the method can include providing a probe having a first segment (metallic) and a third segment (metallic) separated by a second segment (nonmetallic) and contacting the probe with the corrosive medium. The third segment and the metallic object can be connected while impressing an electrical current to the metallic object. The electrical connection between the third segment and the metallic object can be interrupted and the voltage difference between the first segment and the third segment measured. This is representative of the polarization magnitude on the metallic object resulting from the active cathodic protection system. Based on the estimated polarization, the amount of cathodic protection provided to the metallic object can be assessed. The amount of electrical current being impressed onto the metallic object an be adjusted to ensure a proper amount of cathodic protection is being supplied. In an example embodiment, the first segment of the probe has been designed to represent a coating holiday on the pipe. In areas where overprotection is a concern, the roles of the first segment and third segment are reversed. Under normal operation, the first segment is normally connected to the object and the third section is only connected long enough to achieve stable polarization chemistry on its surface. The magnitude of polarization measured between the first and third segments with the first segment momentarily disconnected can now be compared to laboratory data to determine if the potentials may cause coating degradation. In an alternative, the step of providing electrical connection between the first segment and the metallic object, and the third segment and the metallic object will involve connecting a conductive member (wires) where the connections have selectively open and closed switches. The electrical connection between the first segment and the metallic object can be interrupted by opening the switch. The electrical connection between the third segment and the metallic object can also be interrupted by opening that switch.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
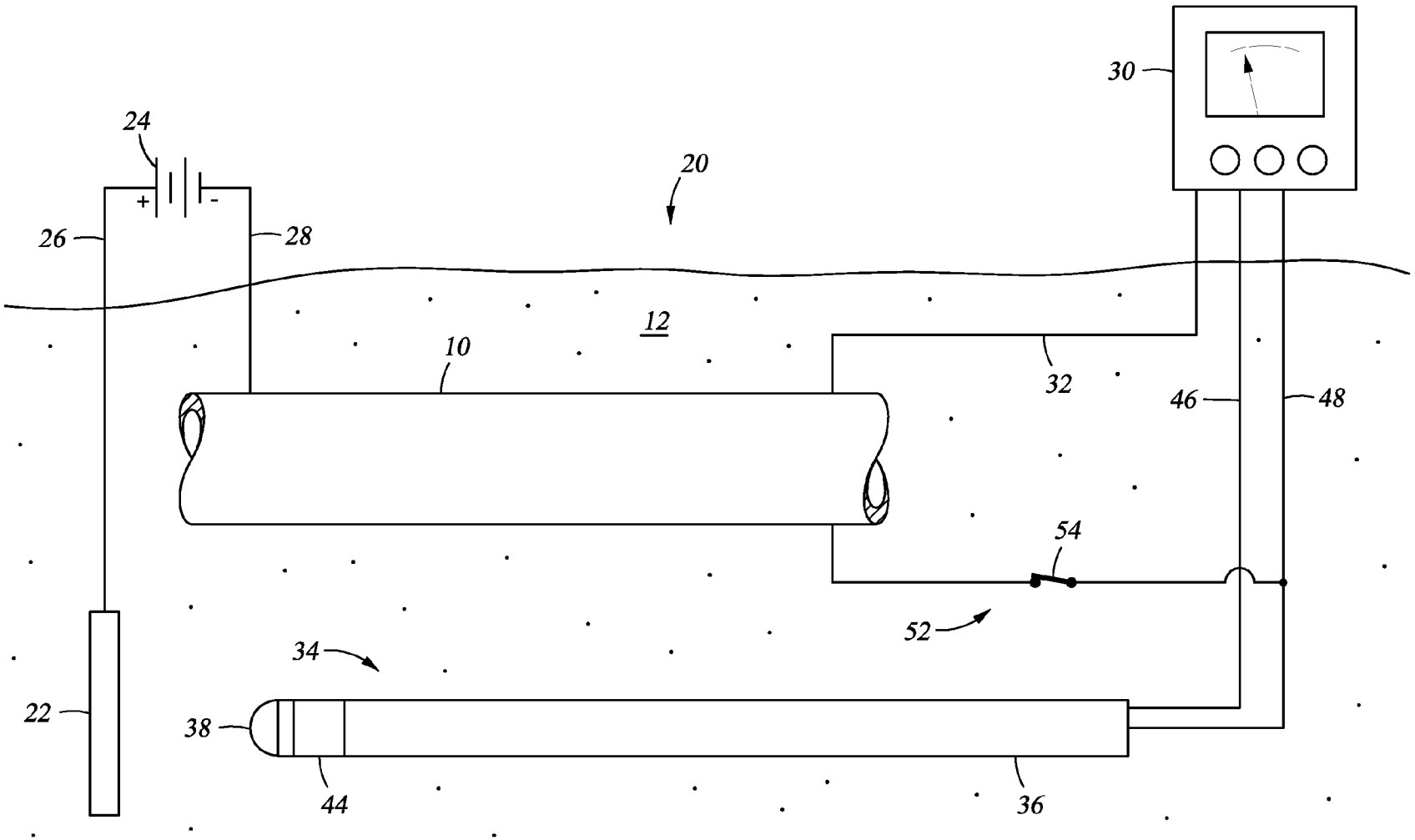
FIG. 1 is a schematic view of an example embodiment of a cathodic protection system in accordance with the present disclosure.

Illustrated in FIG. 1 is a schematic depiction of an impressed current cathodic protection system 20 providing corrosion protection for an object 10 when disposed in a medium 12. Although shown as wholly within the medium 12, the protected object 10 can be partially submerged within the medium 12 or adjacent but in contact with the medium 12. In the embodiment of FIG. 1, the protected object 10 is represented as a tubular; alternatively, the protected object 10 can be a pipeline, a storage tank, or a structure. Optionally, the object can be a marine structure, such as an offshore rig, a reinforcing bar, or immersion services in vessels. The medium 12 can be soil, sand, rock, clay, water, concrete, or anything having a component constituting a corrosive electrolyte requiring the protected object 10 to receive cathodic protection. In an example embodiment, present in the medium 12 are electrolytes, electrolytic compounds, and the like that corrosively attack the protected object 10.

The embodiment of the cathodic protection system 20 of FIG. 1 is shown having an anode 22 (shown immersed in the medium 12) and a power source 24 connected via wires 26, 28 to both the anode 22 and protected object 10. The power source 24 can be a battery providing direct current, or a rectifier coupled with an alternating current conducting power line. Connection with the power source 24 via the wire 28 impresses a cathodic protection current onto the protected object 10. The combination of the impressed cathodic protection current onto the protected object 10 and the buried anode 22 can mitigate corrosive effects of an electrolyte on the protected object 10. In an example, cathodic protection is accomplished by negatively polarizing the protected object 10 in the medium 12 in which the protected object 10 is disposed.

A multi-meter 30 is shown schematically coupled to the protected object 10 via a line 32. The multi-meter 30 is also shown in electrical communication with a segmented probe 34. In an example embodiment, the multi-meter 30 can be a meter for measuring electrical potential and/or resistance. Optionally, the multi-meter 30 can represent multiple meters, where each meter measures a single condition, i.e. potential or resistance. In the example of FIG. 1, the probe 34 includes a first segment 38, which is an electrode, a second segment 44, which is an insulator, and a third segment 36, which is an electrode. Wires 46, 48 from the multi-meter 30 respectively connect to the electrodes 36, 38. In an example of use, after approximately 30 days one of the two electrodes 36, 38 can be disconnected from the protected object 10, depending on whether a concern exists with protection levels that are too high, or too low. About 30 days is required to generate a change in the chemistry of the medium around the electrode and on the surface of the electrode 36, 38 that will occur due to the application of cathodic protection. Once the chemistry of the medium 12 around the electrode 36, 38 and the polarization film on the electrode 36, 38 has stabilized, it should be disconnected from the object 10. It now represents the depolarized state of the object. The multi-meter 30, which in an embodiment can be an off-the-shelf voltmeter, can now be connected between the two electrode 36, 38. The as-connected reading measures the polarization magnitude of the object 10, plus the IR drop error. Moreover, by disconnecting the electrode 36, 38 from the object 10, the instantaneous voltage measured represents the polarization magnitude of the object 10 only. An advantage of the system 30 disclosed herein is the voltage measurement may be done without interrupting CP system(s) operations, without the need for a portable reference electrode, and without inconsistencies resulting from changes in placement of the portable reference electrode as would typically occur.

Figure 2A:
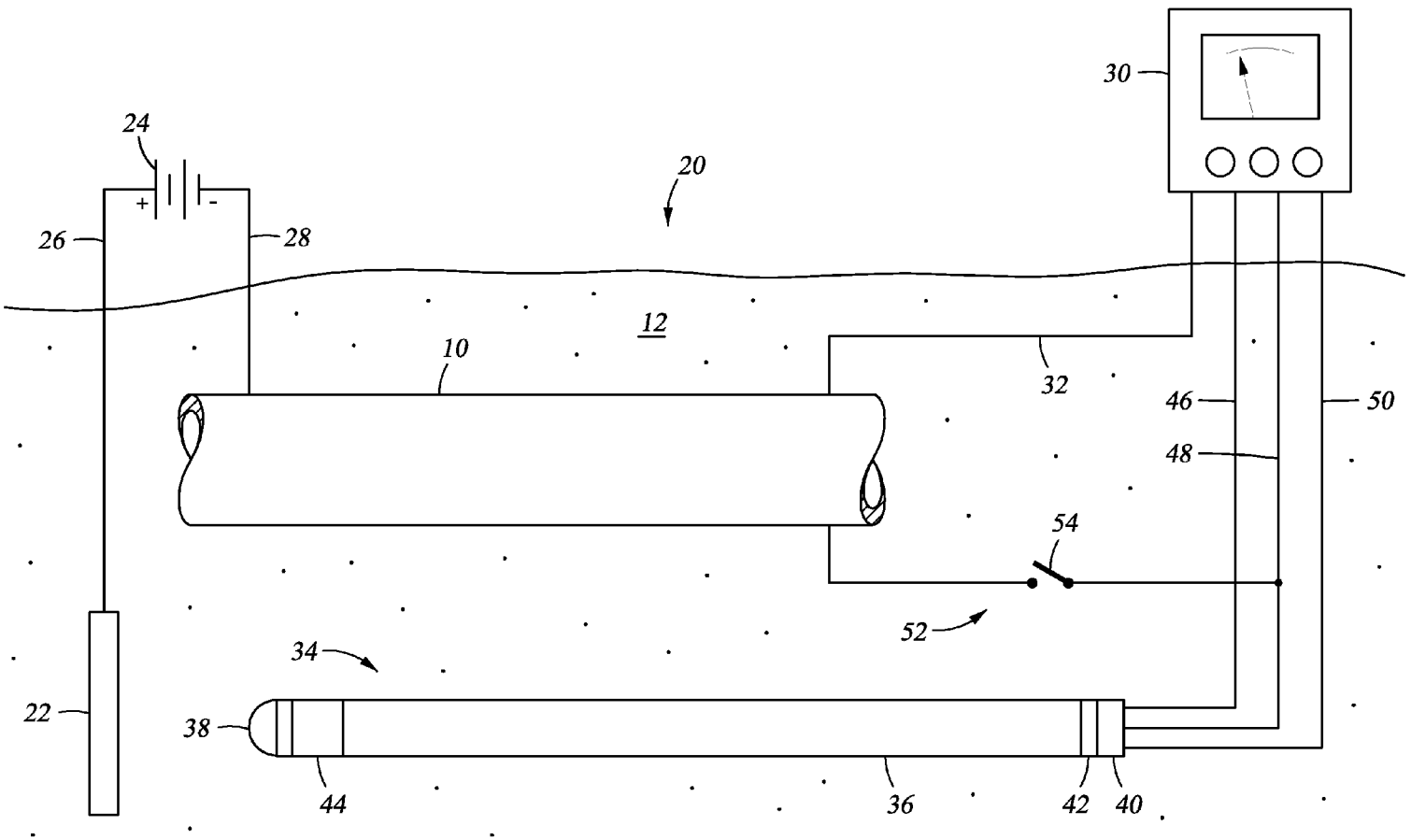
FIG. 2A is an alternate embodiment of the cathodic protection system of FIG. 1.

In an alternate embodiment of a cathodic protection system 20, which is schematically illustrated in FIG. 2A; the probe 34 includes two additional segments to make up a total of five segments; where the fourth segment 42 is a frangible electrode and the fifth segment 40 is an electrode. In an example embodiment, the fourth and fifth segments 42, 40 are substantially thinner than the other segments 36, 38, 44. Further in the example of FIG. 2A, the frangible connection 42 provides electrical connection between the third and fifth segments 36, 40. In an alternative embodiment, the frangible connection 42 includes galvanically less noble elements that are anodic relative to electrodes 36, 40. If the electrolyte is galvanically corrosive, and there is insufficient cathodic protection on electrodes 36, 40, the frangible galvanic electrode 42 will corrode resulting in electrical isolation between electrodes 36, 40. This effect can be measured with a Megger type instrument. Example materials for use in forming the frangible connection include magnesium, zinc, steel, aluminum, alloys thereof, and combinations thereof. The choice of material for use in the frangible connection 42 can depend on a desired rate or time frame of galvanic corrosion (and thus disconnection) of the frangible connection 42. For example, magnesium galvanically corrodes faster than zinc, and steel galvanically corrodes slower than zinc. Moreover, the corrosiveness of the soil and dimensions of the frangible connection 42 will also affect time and rate of galvanic corrosion. The time and/or rate of galvanic corrosion can depend on a time frequency of a cathodic protection status survey. For fairly frequent surveys, such as for example on the order of every two to three months, a quicker galvanically corroding material could be desired. Whereas less frequent surveys, such as those occurring on an annual or greater basis, may dictate a material that galvanically corrodes fairly slow. For example, the alloy for the frangible connection 42 can be selected so that it is galvanically comparable to the minimum polarized potential criterion for the buried or immersed structure and the electrodes 36, 38. Dimensions of the frangible connection 42 can be designated so that corrosion (and disconnection) would occur if the corresponding cathodic protection system was turned off for a given period of time. In a specific example, the frangible connection 42 would disconnect after one year in 2000 ohm-cm soil if the cathodic protection system is off, and would last indefinitely if the cathodic protection system is always on. It is within the skill of those skilled in the art to determine an adequate material and composition for the frangible connection 42. A connection 44 is shown between the electrodes 38, 36, wherein the connection 44 is an insulating connection that electrically isolates the electrode 38 from the electrode 36. In an example embodiment, the connection 44 is a dielectric.

Figure 2B:
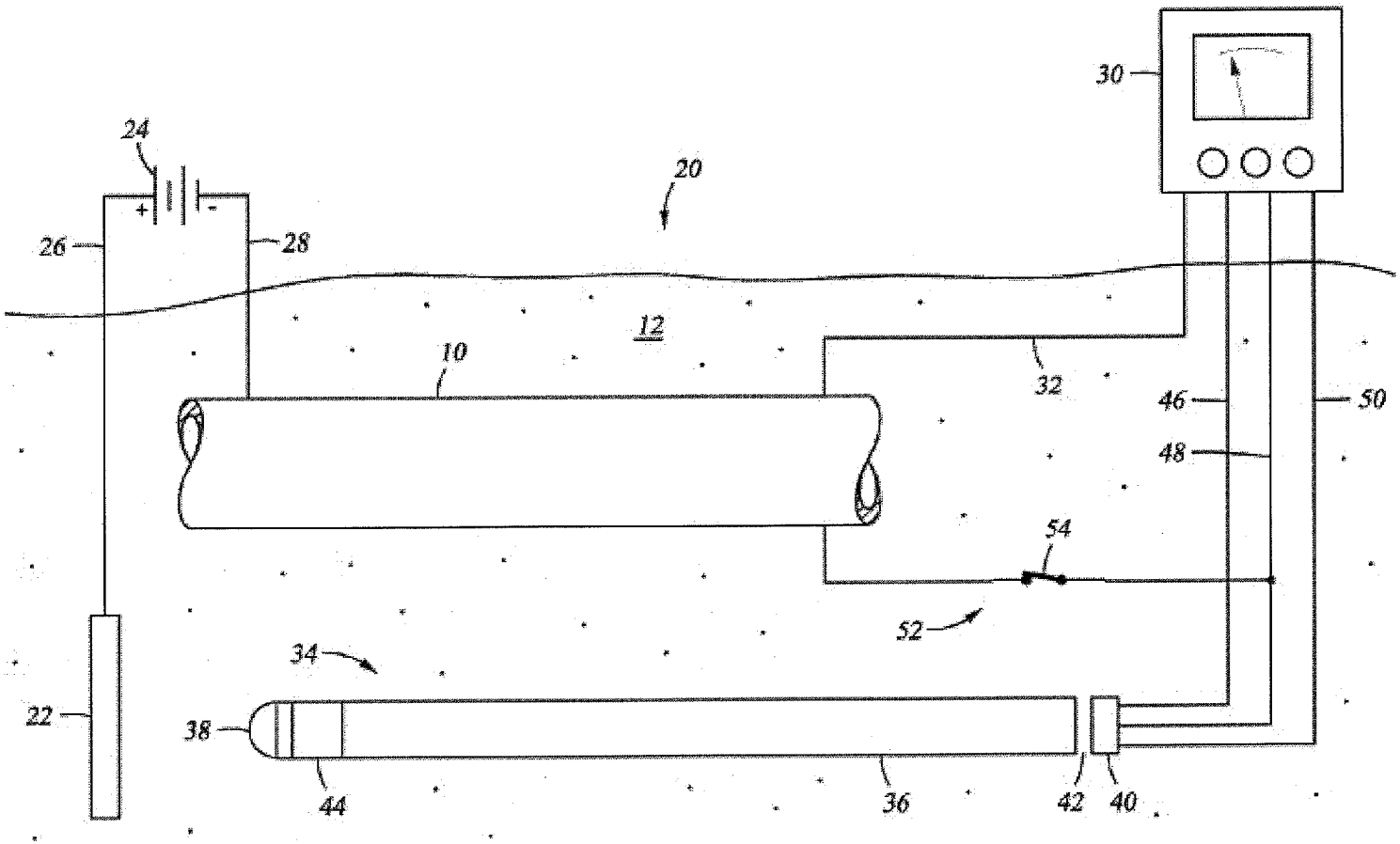
FIG. 2B is an embodiment of the cathodic protection system of FIG. 2A after a period of time.

The example of the probe 34 depicted in FIGS. 2A and 2B is shown as a substantially cylindrical member. In an example embodiment the probe 34 has a length of about 100 millimeters to about 200 millimeters and a diameter of from about 5 millimeters to about 15 millimeters. In one embodiment, the probe 34 has a length of about 150 millimeters and about a 10 millimeter diameter. In another alternative example, the electrode 36 has a length of about 10 millimeters and a diameter of about 12 millimeters, the electrode 38 has a length of about 10 millimeters and a diameter of about 12 millimeters, and the third electrode 44 has a length of around 3 millimeters and a diameter of around 12 millimeters. In an example embodiment, the frangible connection 42 has a length of around 5 millimeters and a diameter of around 12 millimeters. In an example embodiment, the connection 44 has a length of around 5 millimeters and a diameter of around 12 millimeters. The electrode 40 is shown having a disk-like shape to represent a coating defect on a protected object, or a portion of a protected object in contact with, buried, or immersed within a particular medium. Wires 46, 48, 50 are shown that respectively provide electrical communication between electrodes 36, 38, 40 and the multi-meter 30.

Also illustrated in FIGS. 2A and 2B is an electrical communication 52 electrically connecting wire 48 with the protected object 10. Thus, the electrode 38 is in electrical communication with the protected object 10 via the connection 52. A switch 54 is shown that schematically represents selectively controlling electrical continuity between the electrode 38 and the protected object 10. The switch 54 can represent using a link bar method or electrical connection via a common stud bolt or bus bar inside a test station. In an example of use, segments 40, 36 are connected together for a brief period, such as about 30 days, after installation of the probe 34. Under long term operating conditions, when minimum protection levels are being investigated, segment 38 is not connected to anything, but has a test wire that is terminated above ground. Under normal long term operating conditions, when the achievement of minimum protection levels is being investigated, segment 36 can be connected to the object 10 via an interruptible electrical connection, such as a switch or a terminal lug. During measurement, segment 36 would be temporarily disconnected then reconnected after completion of the measurements.

Referring now to FIG. 2B, an example of the probe 34 of FIG. 2A is provided wherein the connection 42 has corroded over time to create an open circuit thereby electrically isolating the electrode 36 from the electrode 40. The switch 54 of the electrical connection 52 remains closed, thereby maintaining electrical communication between the electrode 36 and the protected object 10. Thus in this example embodiment, the electrode 36 is initially polarized to the same potential as the protected object 10 and the electrode 40. However when the frangible element 42 corrodes and disconnects, the electrode 40 will lose electrical continuity with the protected object 10 and the electrode 36, and its potential will fall to a level comparable to the electrode 38. This loss of continuity can be measured with a Megger instrument for indicating that cathodic protection, if sufficient at the time of measurement, was insufficient for some period of time before the measurement.

Figure 3:
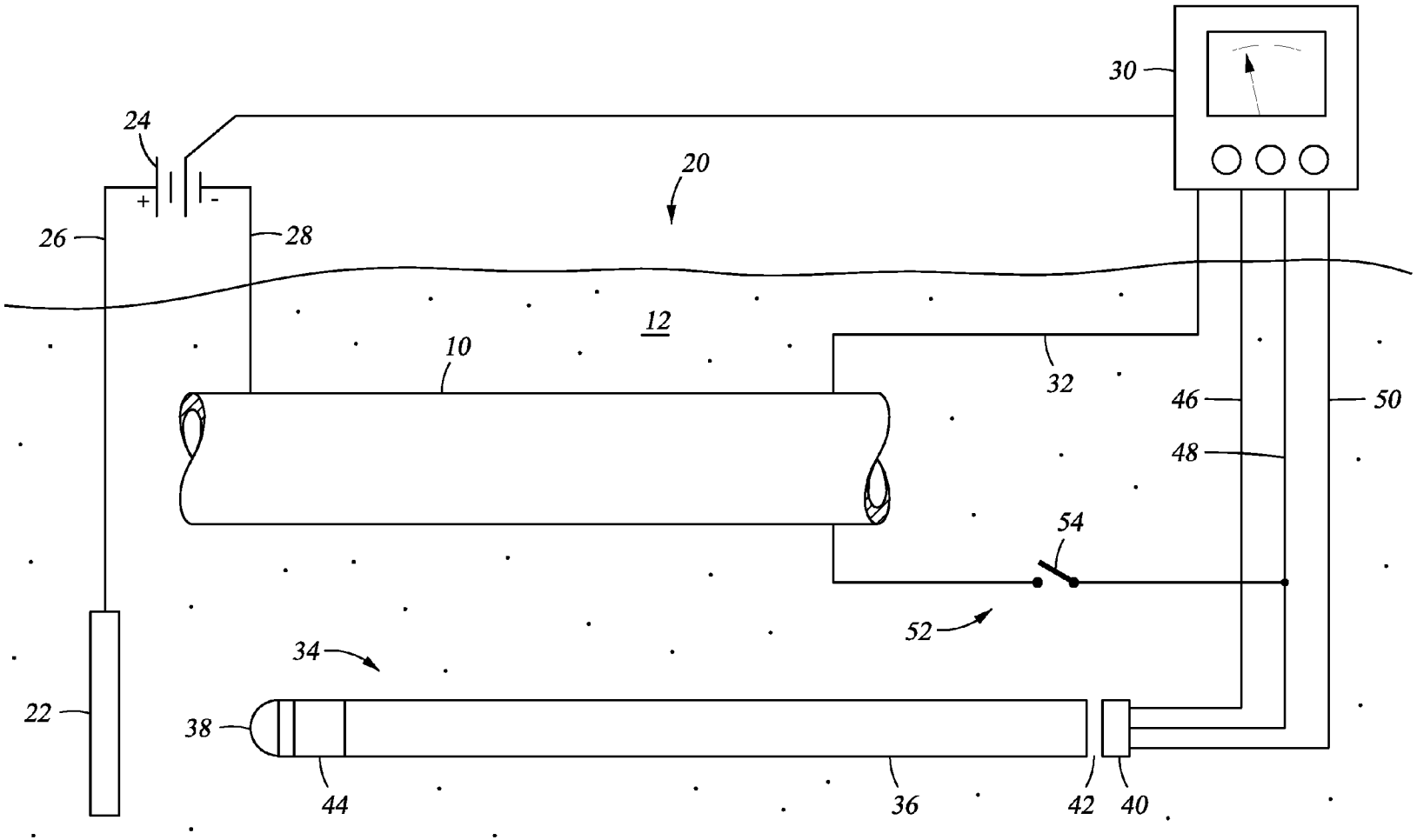
FIG. 3 an alternate embodiment of the cathodic protection system of FIG. 2B.

With reference now to FIG. 3, shown is a schematic representation of the cathodic protection system 20 coupled with the protected object 10 and wherein the switch 54 is in the open position. In this configuration, the electrical potential of the electrode 36 will instantly decrease from that of the protected object 10 by moving the switch 54 into the open position from the closed position of FIGS. 1, 2A, and 2B. Thus measuring the potential in the electrode 36 after opening the switch 54 (or any other method of electrically isolating the electrode 36 from the protected object 10) yields the instant off potential of the protected object 10. In an example embodiment, the electrical potential is measured immediately or instantaneously after the electrode 36 and protected object 10 are disconnected. It should be pointed out that in the method described herein the instant off potential can be obtained without interrupting cathodic protection current flow to the protected object 10. Additionally, a value for the amount of polarization of the object 10 can be obtained by measuring the voltage difference between the electrodes 36, 40 after opening the switch 54; also available with this measurement is the polarization decay that would occur if cathodic protection were removed from the protected object 10 for a period of time. Still referring to FIG. 3, the electrode 38 is electrically isolated from the electrode 36 and disposed within the medium 12; thus the electrode 36 will assume a potential and/or polarization substantially the same as the electrode 38.

Referring back to FIG. 1, in an example of operation of the cathodic protection system 20 described herein, the segmented probe 34 is disposed into contact with the same medium 12 in which the protected object 10 is in contact. As discussed above, the contact can be fully or partially submerged therein or adjacent to and in contact with the medium 12. While impressing a current upon the protected object 10, such as by the connection with the power source 24, the electrode 36 is in electrical communication with the protected object 10. Electrical continuity between the electrode 36 and the protected object 10 substantially equalizes the potential between the electrode 36 and the protected object 10. Referring now to FIG. 2B, in example embodiments when the connection 42 is formed from a galvanically corroding material, the connection 42 galvanically corrodes to electrically isolate the electrode 36 from the electrode 40. In the embodiment shown in FIG. 2B, electrical connection is maintained between the electrode 36 and protected object 10 via the electrical connection 52 and through the closed switch 54. Accordingly, the electrode 36 will become depolarized with respect to the electrode 40 (and the protected object 10), but will over time attain substantially the same polarization level as the electrode 38 with respect to a reference electrode (not shown) placed in the same medium 12.

In an alternative embodiment, the electrode 40 is in electrical communication with electrode 36; in this embodiment the electrode 36 can be used to measure cathodic protection levels for determining if adequate cathodic protection is being delivered. After an initial polarization period, electrode 38 is electrically isolated from both the electrodes 36, 40. When electrically isolated, the electrodes 36, 38 can be used to assess an instant depolarization magnitude. In an example embodiment, an initial depolarization magnitude should be at least about 100 mV.

Referring back to FIG. 3, the switch 54 is put into the open position thereby preventing flow of impressed current through the connection 52 to the electrode 36 from the protected object 10. Measuring a polarization value of the electrode 36 instantly after the switch 54 is open (instantaneous off potential or instant off) yields the polarization value of the protected object 10. An advantage provided by the method described herein is polarization measurements of the protected object 10 may be obtained without IR error, such as from the impressed current. As noted above, measured potential or polarization of the protected object 10 is indicative of the level of cathodic protection received by the protected object 10 and polarization decay can be measured by the voltage difference between the electrodes 36, 38. Thus, measuring electrical potentials in the electrodes 36, 38 when the switch 54 is in the open position, can provide an error free method of assessing cathodic protection of the protected object 10. With the above two measurements, the operator will be able to satisfy the measurement for two criteria: (1) the instant off measurement–industry standard minimum criterion of −850 mV relative to $Cu/CuSO_4$ electrode; and (2) the polarization decay–industry standard minimum criterion of 100 mV. In an example, electrical potentials in the electrodes 36, 38 are measured by the multi-meter 30.

In situations when inadequate or overabundant levels of cathodic protection are supplied to the protected object 10, a controller (not shown) can be configured to recognize situations of undesired cathodic protection and adjust the power supply 24, such as via a communication link (not shown), to provide more or less voltage. Adjusting the power supply 24 in turn can affect the level of impressed current imparted onto the protected object 10. Another advantage of the system and method described herein is that representative "instant off" readings for the protected object 10 can be taken without disconnecting or interrupting the power provided from the power supply 24 via the wire 28. Also, electrodes 36, 38 can be used to measure resistivity of the medium, such as the soil or water, adjacent the protected object 10.

As noted above, the electrode 38 emulates a coating flaw, wherein monitoring potential across the electrode 38 can indicate if the level of cathodic protection is damaging to the coating. Knowing a maximum acceptable cathodic protection potential for a particular coating flaw, the comparable size for a given coating, readings from the electrode 38 can be monitored to ensure a maximum cathodic protection level is not exceeded. It has been observed that as cathodic protection levels for a protected object are raised, the area of a coating defect on the object correspondingly increases in a generally linear fashion; however, at some point the defect begins to increase non-linearly with respect to increasing cathodic protection levels. Thus in an example embodiment, the maximum amount of cathodic protection is set at around where the level of cathodic protection causes an area of a coating defect on a protected object to increase non-linearly. For example, it has been observed that by first applying and then increasing cathodic protection potentials for a protected object, the amount of cathodic disbondment suffered by the coating varies with applied current. Initially, the cathodic disbondment of the coating decreases with low to moderate cathodic protection current densities. But at some point the amount of disbondment begins to increase as the cathodic protection current density increases. The potentials where these transitions occur are dependent on specific coating and electrolyte characteristics. These transitions points can be determined in lab simulations and correlated to field measurements using the electrode 38 on the probe 22. In this manner, high potential levels that would cause undo damage on a given coating in a given electrolyte can be avoided by adjusting the cathodic protection system to maintain structure potentials below customized criteria Monitoring connectivity between the electrodes 36, 40 can assess whether or not cathodic protection may be necessary. For example, if continuity between the electrodes 36, 40 is monitored, this can indicate that the connection 42 has not galvanically corroded. If the connection 42 remains intact over a period of time after being immersed in or otherwise in contact with a particular medium, cathodic protection will likely not be required for the protected object 10 also within the same particular medium. Optionally, in situations when a protected object is already receiving cathodic protection, adequacy of cathodic protection may be verified by continued integrity of the connection 42. That is, the anode 22 is successfully counteracting the effects of any potentially corrosive electrolytes in the medium 12. Moreover, monitoring continuity over time between the electrodes 36, 40 can qualitatively allow the cumulative galvanic corrosion to be determined by the increase of resistance of the connection 42.

Example

In a non-limiting example, a fusion bonded epoxy (FBE) was applied to an outer surface of a pipe. This test was done on a rounded conical shaped engineered gouge in a coated piece of pipe tested in the lab. Reference data was collected by forming test defects, or holidays, in the coating using a 6 mm drill bit. In one test, six defects were formed at equally spaced apart locations that were along a path substantially parallel with an axis of the pipe. An isolated cathodic protection (CP) cell was fabricated for each defect and energized at six different cathodic protection levels (potential referenced to $Cu/CuSO_4$ electrode) for 60 days. At 0.0 cell current and a starting potential of −780 mV, after 30 days a disbondment surface area of 3.2 $cm^2$ was formed. At $5\times10^{-6}$ amps of cell current and a potential of −1000 mV, after 30 days, a disbondment surface area of 1.6 $cm^2$, i.e. reduced coating damage. For this type of coating in this medium, polarized potentials on electrode 40 were kept below −1100 mV. The resulting damage to the coating was measured and a maximum cathodic protection criterion (relative to a $Cu/CuSO_4$ electrode) determined for FBE in each environment. The test was repeated several times with several different electrolytes in the cells to represent a variety of actual field soil conditions. In an alternative, a correlated electrode can be formed with a geometry and dimensions that approximate the geometry and dimensions of the test defects described above. The assessment can include comparing the measurements of the correlated electrode to the measured potentials of the reference data. Thus, installing the correlated electrode for use with a cathodic protection assessment probe as described herein, and measuring potential on the electrode, can be used to assess if the cathodic protection being supplied could be damaging to the coating, or how much the coating might be damaged. In an example embodiment, the electrode 38 is a correlated electrode. If the cathodic protection level is determined to not be damaging to the coating, the level of cathodic protection can be increased. Optionally, if the cathodic protection level is determined to be damaging, the level can be reduced and additional cathodic protection units installed to provide a more uniform potential level over the length of the pipeline. Field soil conditions can also be estimated by measuring in-situ soil resistivity with a correlated electrode, possibly in combination with another electrode, and correlating the measured resistivity to the reference data.

Figure 4:
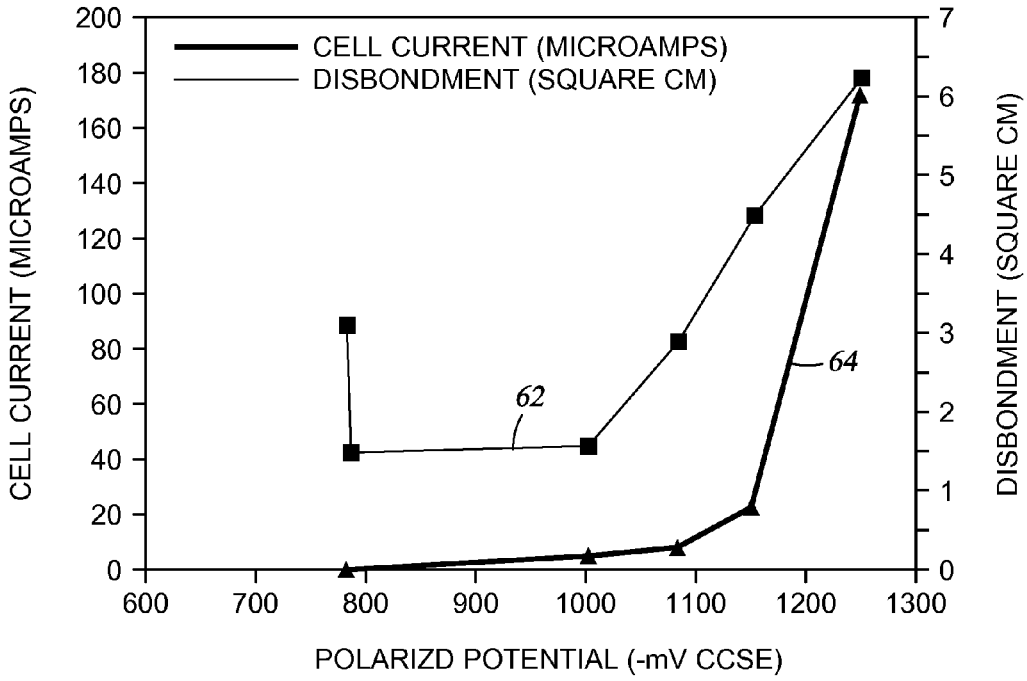
FIGS. 4 and 5 are plots of disbondment tests.
Figure 5:
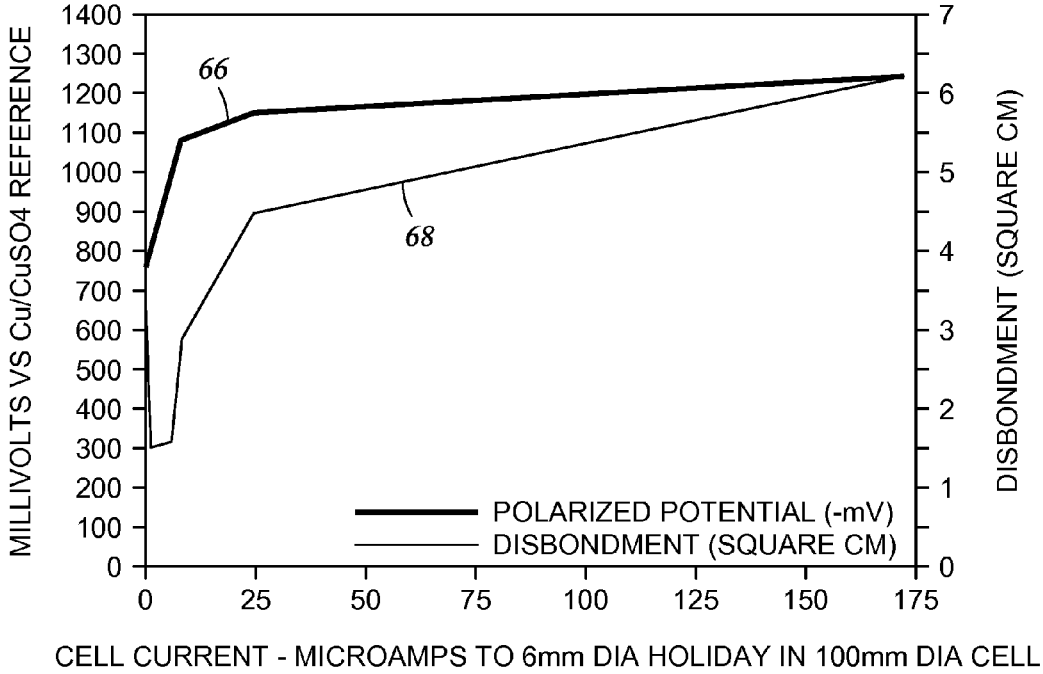

At small to moderate levels of CP (relative to potential), FBE disbondment is reduced compared to no CP. In other words, CP reduces coating damage up to a certain level of CP. Beyond this level, the amount of coating damage increases as shown in FIGS. 4 and 5; that include graphs having plots generated from test data obtained in the Example above. The plots can be used for assessing levels of cathodic protection applied to an object. Along the abscissa of the graph of FIG. 4 are values of disbondment ($cm^2$) and current (micro-amps). The values on the ordinate represent potential in millivolts measured at the holidays. Plot 62 in FIG. 4 represents disbondment vs. potential and plot 64 represents current vs. potential. Along the abscissa of the graph of FIG. 5 are values of disbondment ($cm^2$) and potential in millivolts vs. $Cu/CuS0_4$ reference. The values on the ordinate of the graph in FIG. 5 represent current (micro-amps) measured at the holidays. Plot 66 in FIG. 5 represents potential vs. current and plot 68 represents disbondment vs. current. The above two examples indicate that a significant increase in coating damage through disbondment occurs when polarized potentials exceed 1000 mV. To correlate this information to operating conditions on a given pipeline, the electrode 38 would be connected to the pipeline via the test station during normal operating conditions. Then the electrode 38 would be disconnected from the pipeline and the instant off reading measured relative to a portable reference electrode. If the instant off potential exceeds 1000 mV, it would be advisable to reduce the output of the cathodic protection power supply.

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims.

What is claimed is:

1. A system for measuring cathodic protection of a protected object contacting a medium and protected by an impressed current and an energized anode contacting the medium, the system comprising:

a probe assembly disposable in the medium and that comprises, a first probe member, an insulating segment coupled on an end of the first probe member; and a second probe member on an end of the insulating segment distal from the first probe member and electrically insulated from the first probe member;

an electrical connection between the protected object an electrical meter; and a selectively openable electrical connection between the object and the first probe member that bypasses the electrical meter, so that when the electrical connection is selectively open and the probe assembly is disposed in the medium so that the first and second probe members are in direct contact with the medium, a measurement of the polarization potential between the first and second probe members substantially reflects the polarization of the protected object.

2. The system of claim 1, further comprising connection on an end of the first probe member distal from the insulating segment, and a third probe member on an end of the connection distal from the first probe member.

3. The system of claim 2, wherein the connection comprises a material that is less galvanically noble than the first and third probe members, so that when the probe is set in a galvanically non-corrosive medium an electrical communication is maintained between the first and third probe members through the galvanically corroding connection, and when the probe is set in a galvanically corrosive medium the connection galvanically corrodes and the first and third probe members are electrically isolated.

4. The system of claim 1, further comprising a multi-meter in electrical communication with the protected object and the first probe member.

5. The system of claim 4, wherein the second probe member has an exposed surface area that simulates a coating defect of a known size and shape on a protected object.

6. The system of claim 1, wherein a power supply provides the impressed current.

7. The system of claim 1, wherein the electrical connection comprises an electrically conducting member and an on off switch in the electrically conducting member.

8. The system of claim 1, wherein the protected object is selected from the list consisting of a pipeline, a tank, a structure, a reinforcing bar, and a vessel.

9. The system of claim 1, wherein the medium is selected from the list consisting of soil, sand, rock, clay, water, a cementitious material, and combinations thereof.

10. A cathodic protection system for cathodically protecting a metallic object contacting a medium, the cathodic protection system comprising:

a power source in electrical communication with the metallic object, so that when the power source is energized current is impressed onto the metallic object;

an anode in electrical communication with the power source and contacting the medium;

a probe assembly in the medium comprising first and second probe members electrically isolated from one another by an insulator and that are selectively in direct contact with the medium;

a selectively disconnectable electrical connection between the first probe member and the metallic object; and an electrical meter in communication with the metallic object and the first probe member, so a polarization value of the metallic object can be estimated by measuring a polarization value of the first probe member just after opening the electrical connection.

11. The cathodic protection system of claim 10, further comprising a third probe member tousled to the first robe member with a connection that is galvanically less noble than the first and third probe members.

12. The cathodic protection system of claim 11, wherein the second probe member comprises a surface with a known size and shape that correlates to a coating defect on a protected object, so that when electrical potential is applied to the first segment, a measured electrical potential between the surface on the third segment and the medium can be used to assess a maximum level of cathodic protection for the metallic object.

13. The cathodic protection system of claim 10, wherein the electrical connection comprises an electrically conducting member that bypasses the electrical meter and an on off switch in the electrically conducting member.

14. The cathodic protection system of claim 10, wherein the metallic object is selected from the list consisting of a pipeline, a tank, a structure, a reinforcing bar, and a vessel.

15. The cathodic protection system of claim 10, wherein the medium is selected from the list consisting of soil, sand, rock, clay, water, a cementitious material, and combinations thereof.

16. A method of monitoring cathodic protection of a metallic object having at least a portion contacting a medium, the method comprising:

(a) providing a probe assembly having first and second probe members electrically insulated from one another, and disposing the probe assembly within the medium so that the first and second probe members are in direct contact with the medium;

(b) providing electrical connection between the first probe member and the metallic object while an electrical current is being impressed onto the metallic object;

(c) interrupting the electrical connection between the first probe member and the metallic object;

(d) measuring the polarization between the first and the second probe member segment; and (e) estimating the amount of cathodic protection provided to the metallic object based on step (d).

17. The method of claim 16, further comprising adjusting the amount of electrical current being impressed onto the metallic object.

18. The method of claim 16, wherein the step of providing electrical connection between the first probe member and the metallic object comprises connecting a conductive member between the first probe member and the metallic object having a selectively open and closed switch and selectively closing the switch, and wherein the step of interrupting the electrical connection between the first probe member and the metallic object comprises opening the switch.

* * * * *